US007641129B2

(12) United States Patent
Farrington

(10) Patent No.: US 7,641,129 B2
(45) Date of Patent: Jan. 5, 2010

(54) RAIL DAMPER

(75) Inventor: David Farrington, Penrith CA (GB)

(73) Assignee: Corus UK Limited, London (GB)

( * ) Notice: Subject to any disclaimer, the term of this patent is extended or adjusted under 35 U.S.C. 154(b) by 396 days.

(21) Appl. No.: 10/547,785

(22) PCT Filed: Feb. 27, 2004

(86) PCT No.: PCT/GB2004/000811

§ 371 (c)(1),
(2), (4) Date: Jun. 6, 2006

(87) PCT Pub. No.: WO2004/079095

PCT Pub. Date: Sep. 16, 2004

(65) Prior Publication Data

US 2006/0249591 A1 Nov. 9, 2006

(30) Foreign Application Priority Data

Mar. 5, 2003 (GB) ..... 0304985.5

(51) Int. Cl.
*E01B 19/00* (2006.01)

(52) U.S. Cl. ..... 238/382

(58) Field of Classification Search ..... 238/151, 238/172, 175, 382; 104/307
See application file for complete search history.

(56) References Cited

U.S. PATENT DOCUMENTS

| | | | | |
|---|---|---|---|---|
| 5,165,598 | A | 11/1992 | Ortwein | |
| 6,402,044 | B1 * | 6/2002 | Sato | 238/382 |

FOREIGN PATENT DOCUMENTS

| | | |
|---|---|---|
| AT | 399 522 | 5/1995 |
| DE | 36 05 831 | 8/1987 |
| DE | 36 31 492 | 3/1988 |
| EP | 0 628 660 | 12/1994 |
| EP | 1 186 710 | 3/2002 |
| JP | 11-172603 | 6/1999 |
| WO | WO 99/15732 | 4/1999 |

* cited by examiner

*Primary Examiner*—S. Joseph Morano
*Assistant Examiner*—Robert J McCarry, Jr.
(74) *Attorney, Agent, or Firm*—Bacon & Thomas, PLLC

(57) ABSTRACT

A damper (18) for a rail (10), includes a deformable material (20) and an elongate resonant member (20, 24), the resonant member being of a stiff material as compared to the deformable material and being sized to exhibit a resonant frequency in the range of vibration frequencies of the rail, wherein the resonant member includes a clip (26) extending therefrom so as to retain the resonant member and the deformable material in place on the rail. The clip preferably extends laterally of the resonant member to grip the underside of the rail. The clip can have an engagement formation on the end thereof, to engage with a like formation of a further damper located on the opposing side of the rail.

24 Claims, 6 Drawing Sheets

Fig 6a
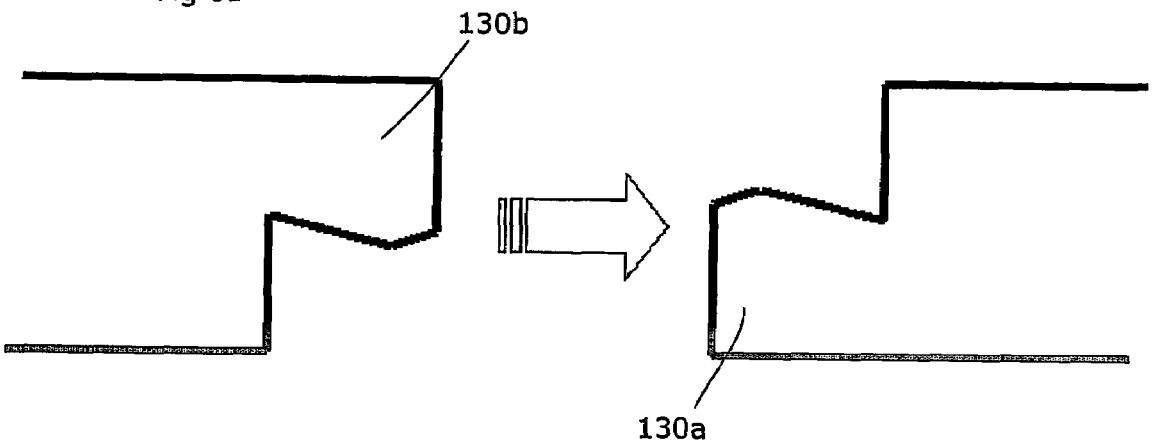
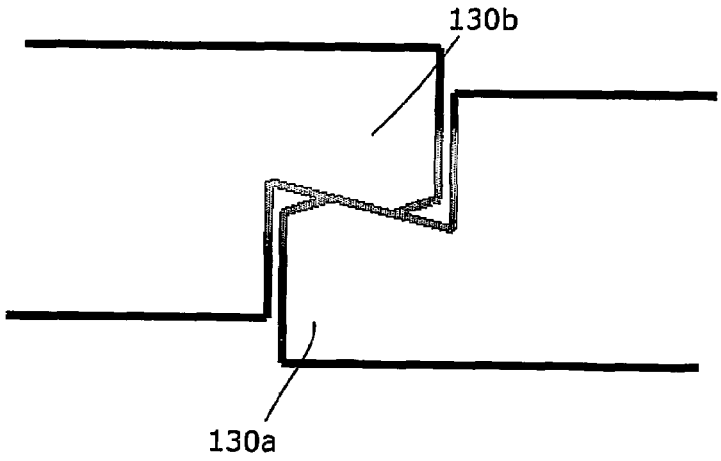
Fig 6b

RAIL DAMPER

FIELD OF THE INVENTION

The present invention relates to a rail damper.

BACKGROUND ART

The noise emitted by moving rail vehicles is a major limitation on their use, in that it will limit the ability of operators to install new lines in populated areas, and will limit speeds and traffic volumes on existing lines. The noise tends to be dominated by rolling noise from the wheel/rail interface, which is caused partly by vibration of the wheels and partly by vibration of the track.

It is not possible to select alternative materials, etc, for these elements since they are subject to very high transient loads during use, and must withstand these. Materials that would be able to absorb vibration and hence reduce noise would be unable to survive in use for any appreciable time. Resilient rail fastenings have been employed to reduce track forces and thereby reduce component damage and structure-borne noise. However, they have an adverse effect on track noise, as they tend to reduce the attenuation of rail vibration.

EP628,660 A1 discloses a rail bar in which a body of high specific mass is arranged within a mouldable material of low specific mass.

Our previous application WO99/15732 discloses a rail damper adapted to absorb a wide range of resonant frequencies in the rail through the use of a damper with resonant members tuned to two frequencies in the spectrum of noise to be absorbed.

SUMMARY OF THE INVENTION

The present invention seeks to provide a means for reducing the track noise emitted by a rail system, along the lines of the systems shown in EP628,660 A1 and WO99/15732 but which are more straightforward to install.

We therefore provide a damper for a rail, comprising a deformable material and an elongate resonant member, the resonant member being of a stiff material as compared to the deformable material and being sized to exhibit a resonant frequency in the range of vibration frequencies of the rail, wherein the resonant member includes a clip extending therefrom so as to retain the resonant member and the deformable material in place on the rail.

The clip allows the damper to be fitted to the rail in an extremely short time as compared to gluing and curing processes, and with greater confidence and less inventory as compared to clamping processes.

The relationship between the resonant member and the deformable material is not crucial to this invention. If desired, the resonant member can be embedded in the deformable material, either by being enclosed or with a surface exposed, or the deformable material can simply be sandwiched between the resonant member and the rail.

The resonant member is elongate and will usually extend alongside the rail. The clip then preferably extends laterally of the resonant member, meaning that it can grip the rail, preferably the underside thereof. The clip can have an engagement formation on the end thereof, to engage with a preformed engagement means or with a like formation of a further damper located on the opposing side of the rail. In this latter case, it is preferred that the engagement formation is symmetrical such that both clips are identical.

A further resonant member can be included, for example as taught in WO99/15732 (or otherwise). The further resonant member is thus preferably sized to exhibit a different resonant frequency in the range of vibration frequencies of the rail. To this end, it can have a different profile to the first resonant member. It can be embedded within the deformable material in the same manner as the first.

The deformable material is preferably in an elongate form and/or continuous. A deformable material that consisted simply of isolated islands supporting the resonant member might be less robust and may have inappropriate elastic properties for transmission of vibration, although these issues may be resolvable through materials selection.

The deformable member can be visco-elastic and/or rubber or rubber-like. It is preferably substantially uniform in composition.

The present invention also provides a rail, to which is attached a damper as defined above. In such a rail, the damper is preferably positioned on the rail so as to cover the junction between the web and the foot of the rail. This will be assisted if at least one (or the) resonant member is an elongate angled section, ideally with an angle that matches the angle between external surfaces of the rail head and foot.

BRIEF DESCRIPTION OF THE DRAWINGS

An embodiment of the present invention will now be described by way of example, with reference to the accompanying figures in which;

FIGS. 6*a* and 6*b* show interlocking parts of clips of the present invention.

DETAILED DESCRIPTION OF THE EMBODIMENTS

Figure 1:
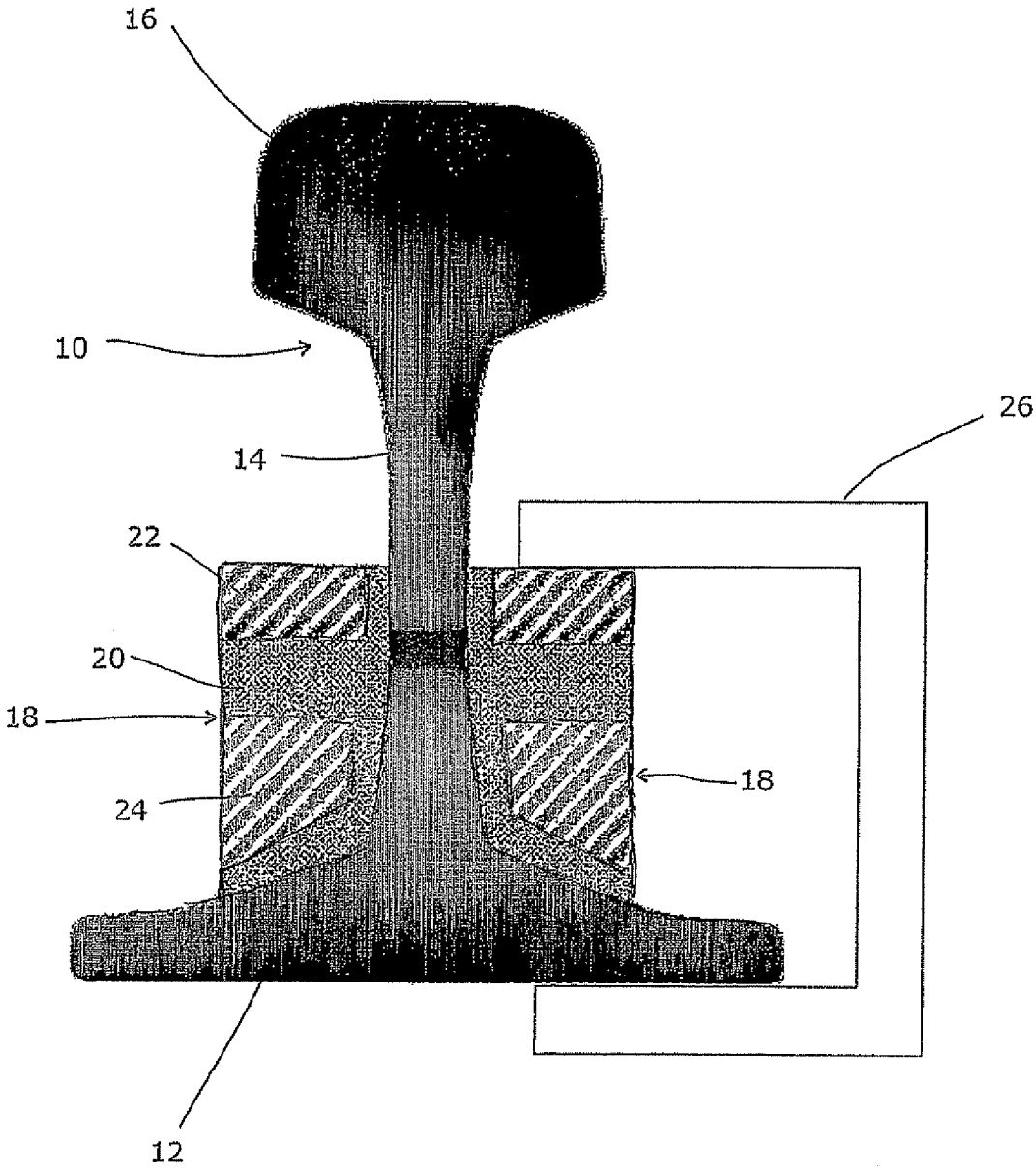
Fig 1 PRIOR ART
FIG. 1 shows a known rail damper held in place with a clamp.

Referring to FIG. 1, a known rail and damper are shown, in which the rail 10 consists of a wide foot 12, a web 14 and an enlarged head 16. On each side of the foot/web join there is a damper 18 constructed in accordance with WO99/15732. This comprises a body 20 of deformable material in which are embedded two elongate bars 22, 24 of a different sectional profile. These bars 22, 24 resonate at different frequencies within the range of vibration frequencies of the rail and the combined body 20 and bars 22, 24 forming the damper 18 absorb a wide range of vibration frequencies from the rail and thereby alleviate noise emissions.

It can however be difficult to attach the damper 18 to the rail 10. One option is to glue the damper in place or to cure the deformable material in place on the rail. This approach gives a good attachment but takes some time to install. Another option also shown in FIG. 1 is to use a C-clamp 26, which urges the damper down onto the rail by compressing it in place. This clamp fixes onto the top surface of the damper 18 and the underside of the rail foot 12. However, this is less secure and requires a wider range of parts to be stocked.

Figure 2:
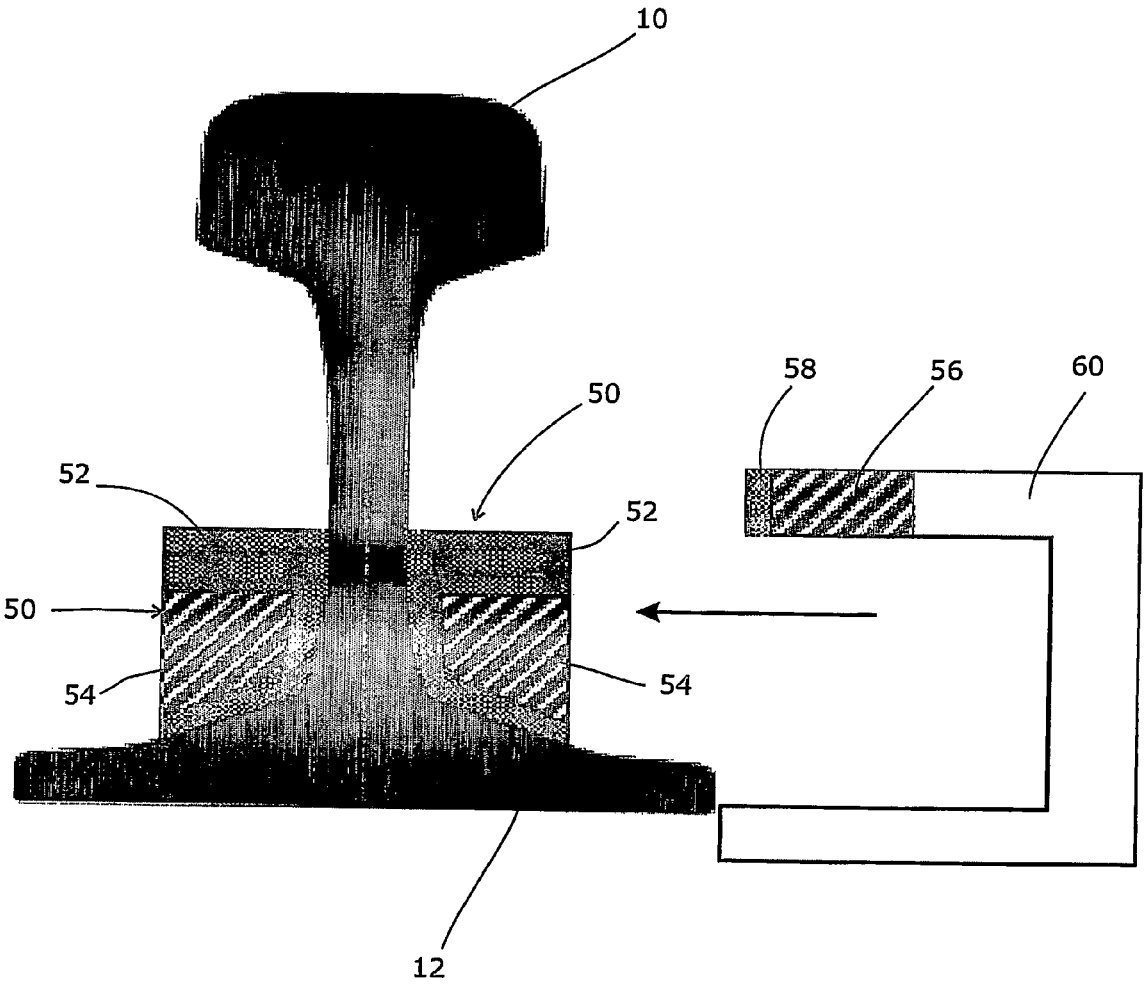
FIG. 2 shows the damper of the present invention in section, in the process of assembly.

FIG. 2 shows an alternative design. The rail 10 is loosely fitted with a first damper 50 comprising a block of first deformable material 52 in which is embedded a first resonant member 54 in the form of an elongate steel rod. A second clamp-on resonant member 56 is provided, in the form of a second elongate rod of a different sectional profile. This has on one side a second strip 58 of deformable material and, extending from the opposing side, one or preferably a plurality of clips 60. In this case, the clips are of a generally C-shaped profile and extend from the rod 56 at intervals. Alternatively, the clips could be continuous along the length of the resonant member. They are sized such that when the rod 56 rests on the upper face of the block 52, the distal end of the C-clip 60 presses against the underside of the rail foot. In this way, once the rod 56 is in place, a two-resonator damper is formed which is already held in place by the clip or clips 60.

As shown in FIG. 2, the first resonator 54 is embedded in the deformable material 52 with only one face of the first resonator being exposed. This is on the outer face of the deformable material 52 and thus there is a layer of deformable material between the first resonator 54 and the rail 10 and on the upper surface of the damper 50. The layer on the upper surface thus lies between the first resonator 54 and the second clamp-on resonator 56 when the latter is in place.

Alternative arrangements are of course possible. For example, an extended layer of deformable material 58 could cover the underside of the second resonator 56, instead of or in addition to the layer of deformable material on the upper surface of the first resonator 54.

Figure 3:
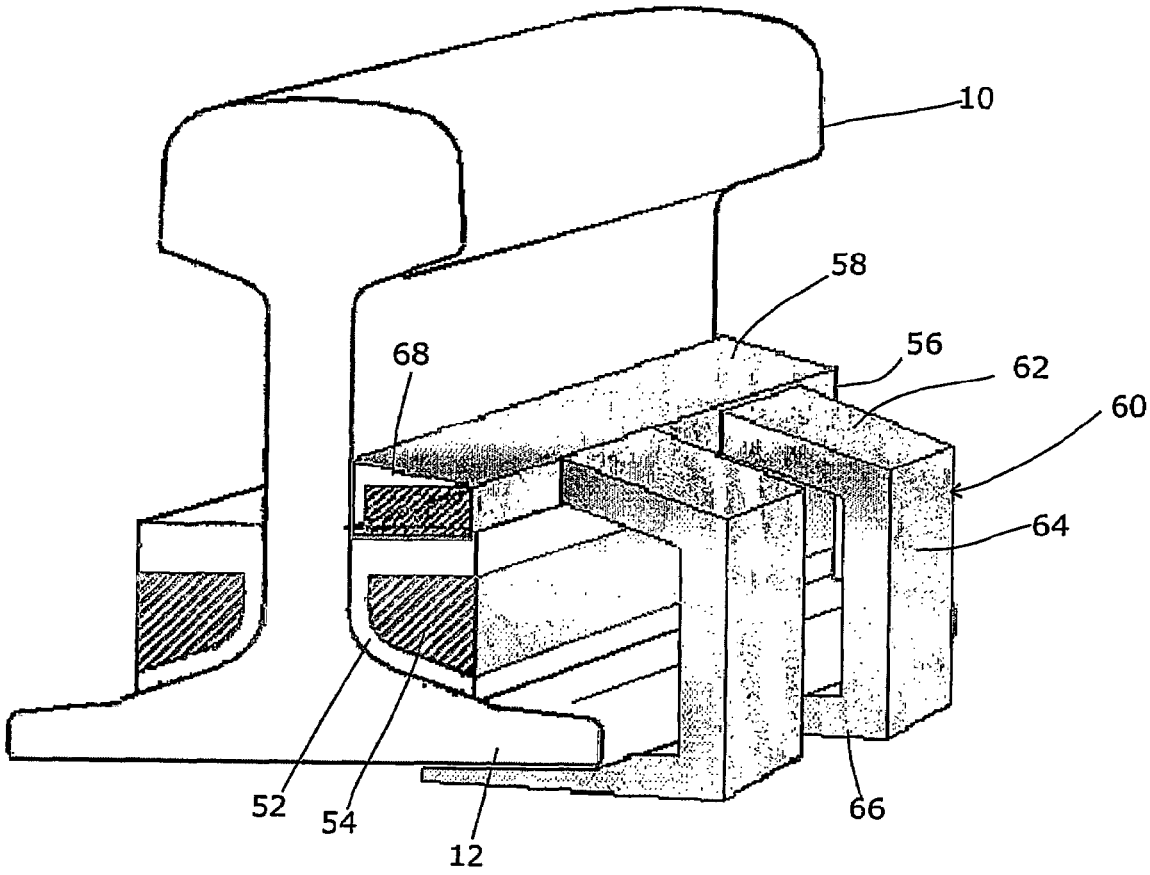
FIG. 3 shows a perspective view of the damper of the present invention, in place.

FIG. 3 shows a section of the elongate resonators 54, 56 and the two clips 60 which extend from the outer face of the second clamp-on resonator 56 and show a C-shaped configuration with the lower edge of the C extending beneath the rail foot 12. As shown in FIG. 3, the clips have a profile which includes an outwardly extending part 62 to provide the necessary clearance of the rail foot 12, a downwardly extending part 64 to cover the distance between the second resonator 56 and the attachment point, in this case the lower face of the rail foot 12, and an inwardly extending part 66 to engage with the attachment point being the underside of the rail foot 12.

FIG. 3 also shows the deformable material 58 attached to the second clamp-on resonator, with a part 68 extending over the upper surface of the second resonator 56. This part of the deformable material is not expected to play a major part In the vibration absorption properties of the damper but may offer an decorative effect and provide a measure of environmental protection.

Figure 4:
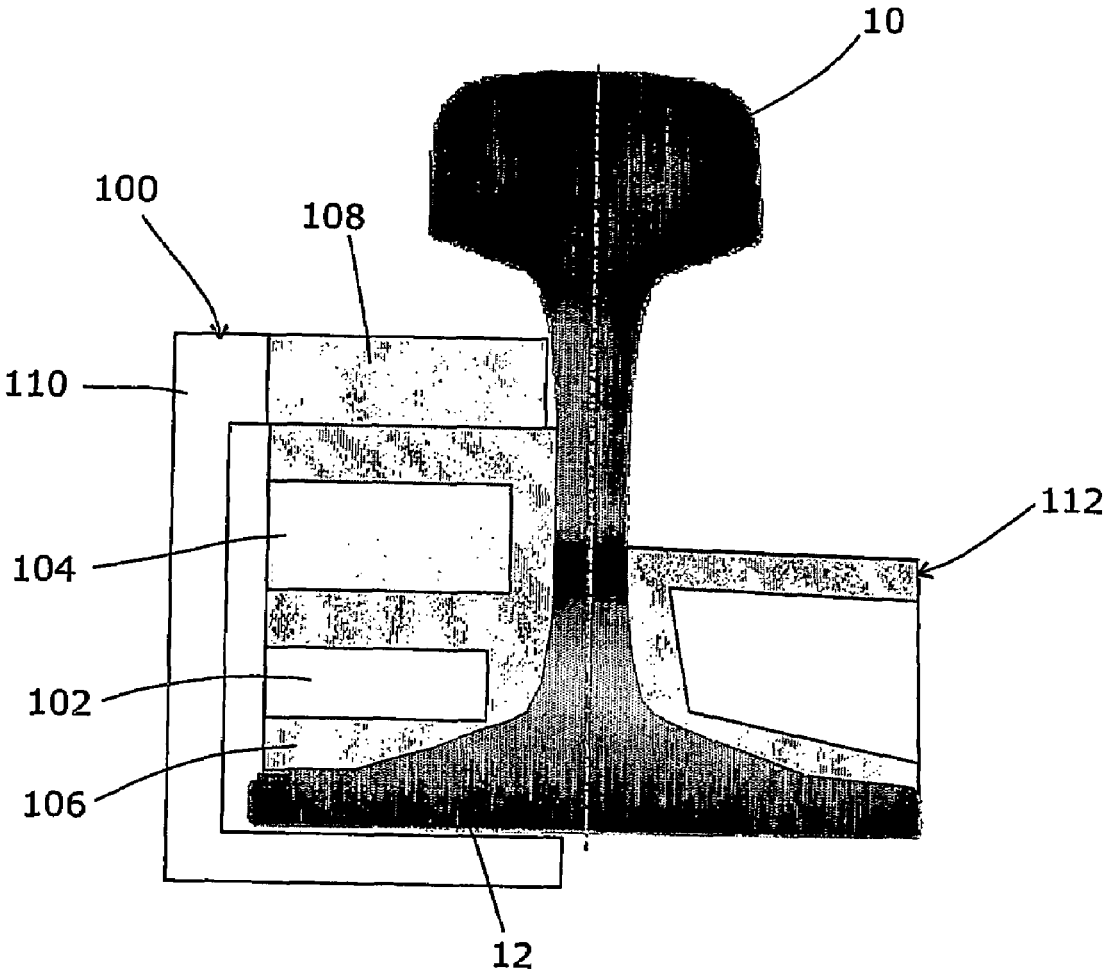
FIG. 4 shows a section of an alternative damper, in place.

FIG. 4 shows a three-mass system 100 secured in place on one side of the rail 10. First and second resonant members 102 and 104 of the three mass system are embedded in a deformable material 106. A third or clamp-on resonant member 108 lies over the deformable material 106 and has one or more clamps 110 which extend beneath the rail foot 12. These clamps resiliently urge the third clamp-on resonant member 108 towards the rail foot 12 and thus trap the first and second resonant members 102, 104 to hold the clamp-on damper 100 in place on the rail. A small clearance is provided between one end of the third clamp-on resonant member 108 and the rail 10 to allow the former to vibrate. This could of course be replaced by a layer of deformable material, but a manufacture step is avoided by using a clearance instead. Vibrations will still be transmitted to the third clamp-on resonator 108 via the deformable material 106 in which the first and second resonators 102, 104 of the three-mass system are embedded.

The three resonators 102, 104, 108 are all of a different cross-sectional profile and all thus generate a system with multiple resonant frequencies. In practice, some resonators could be matched, if desired, or if only a single or double frequency damper was required.

In FIG. 4, a standard single-mass damper 112 is provided on the second side of the rail. The frequency damped by this damper could be the same as one of those damped by the three-mass damper 100 or it could be a fourth frequency. This could of course be replaced with a single-, two- or three-mass damper as set out herein.

Figure 5:
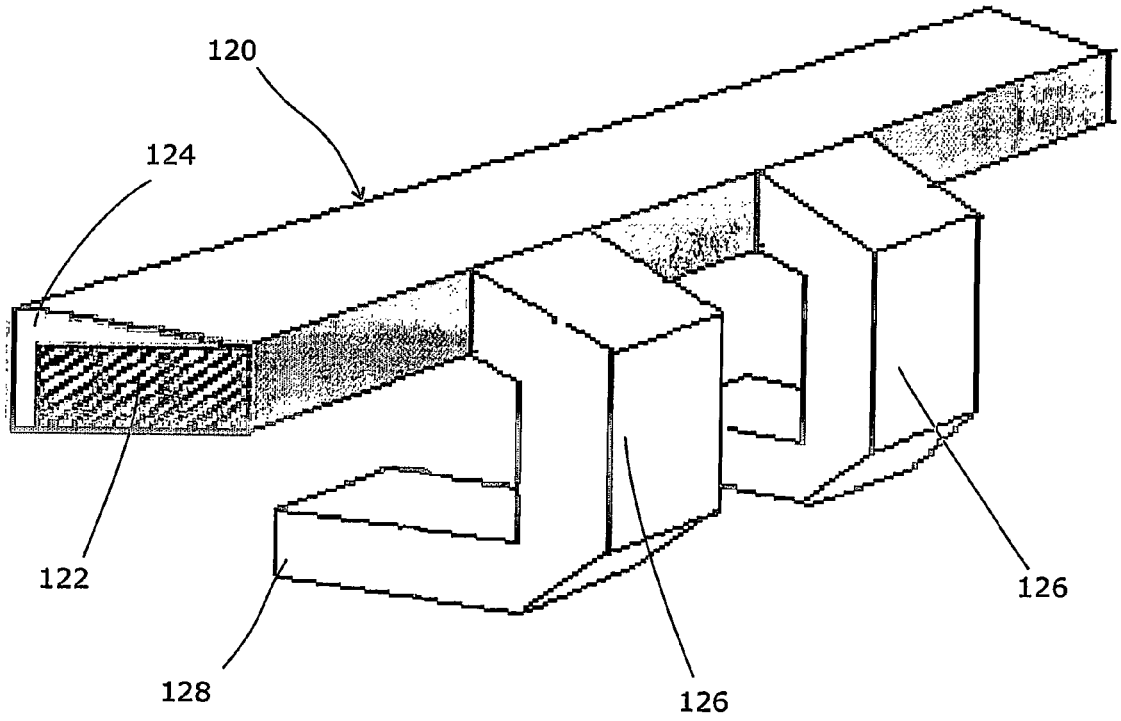
FIG. 5 shows a perspective view of a damper according to the present invention.

FIG. 5 shows a damper 120 comprising a resonator 122 embedded in a deformable material 124 and with (in this case) two clamps 126 extending from the resonator 122 to clamp the latter in place. The dimensions of the clamps can again be adjusted to suit the particular arrangement. A further block of deformable material (not shown) can be interposed beneath the resonator 122 to be clamped in place. This block can contain further resonators tuned to the same or to further frequencies. If there is no further block of deformable material then a layer of deformable material beneath the resonator 122 may be useful.

FIGS. 6*a* and 6*b* show a modified form of the clamp, applicable to any of the various dampers described above. The tip 128 of the clamp (see FIG. 5) will normally lie beneath the rail foot. Where a clamped damper is fitted on either side of the rail, there will be two such tips facing each other. As shown in FIG. 6*a*, these tips can be formed with engagement formations 130*a*, 130*b* that are adapted to lock together. In FIGS. 6*a* and 6*b*, the clamps shown from above, are symmetrical and thus the two parts are identical to evident advantage. A wide range of engagement formations are suitable, including the half-dovetail cam profiles of FIGS. 6*a* and 6*b*.

The materials used for the above-described parts can be any suitable material exhibiting appropriate properties. A rubber or rubber-like material is preferred for the deformable material as this exhibits appropriate visco-elastic properties. The remaining parts are suitably of a ferrous material such as steel, although parts of the clip such as the downwardly extending part 64 could be of a less stiff material such as nylon or a composite such as a plastics/steel composite.

The damper according to the present invention has a number of advantages. In particular;

- the clamping arrangement substitutes for gluing and thereby reduces installation time
- the tuned dampers can have 2 or more masses, as desired
- the dampers can be removed when the life of the rail is expired
- the dampers can be removed for rail maintenance
- the dampers can be wider than known designs, to sit between the sleepers
- the dampers can be higher than the existing design, since they could be removed for tamping operations, although clearance for other equipment such as the worn rail/worn wheel condition will still have to be taken into account It will of course be understood that many variations may be made to the above-described embodiment without departing from the scope of the present invention.

The invention claimed is:

1. A clamp-on damper adapted to be installed on a rail on which at least a first damper is installed along at least one side of the rail, the first damper including a first deformable material and a first elongate resonant member formed of a material stiffer than the first deformable material, the clamp-on damper comprising a second elongate resonant member, the second resonant member being formed of a stiff material sized to exhibit a resonant frequency in the range of vibration frequencies of the rail;

said second resonant member including a clip secured to and extending from the second resonant member that is configured and arranged to engage a rail having the first damper installed thereon so as to retain the clamp-on damper in place on such rail and on the first damper.

2. The clamp-on damper according to claim 1, said clamp-on damper including a second deformable material in which the second resonant member is embedded.

3. The clamp-on damper according to claim 2, in which the second resonant member is enclosed within the second deformable material.

4. The clamp-on damper according to claim 2, in which a surface of the second resonant member of the clamp-on damper is exposed.

5. The clamp-on damper according to claim 2, in which the second deformable material is in an elongate form.

6. The clamp-on damper according to claim 5, in which the second deformable material is continuous.

7. The clamp-on damper according to claim 2 wherein the second deformable member is visco-elastic.

8. The clamp-on damper according to claim 2, wherein the second deformable member is rubber.

9. The clamp-on damper according to claim 2, wherein the second deformable material is substantially uniform in composition.

10. The clamp-on damper according to claim 1, in which the clip extends laterally of the second resonant member of the clamp-on damper.

11. The clamp-on damper according to claim 1, in which the clip is adapted to retain the second resonant member of the clamp-on damper in place on the rail by engagement with an underside of the rail.

12. The clamp-on damper according to claim 1, in which the clip has an engagement formation on one end thereof opposite an end at which the clip is secured to the second resonant member of the clamp-on damper.

13. The clamp-on damper according to claim 12, said clamp-on damper adapted to be located on one side of a rail, and wherein the engagement formation is adapted to engage with a like formation of a further damper located on the opposing side of the rail.

14. The clamp-on damper according to claim 13, in which the engagement formation is symmetrical such that both clips are identical.

15. The clamp-on damper according to claim 1, in which the second resonant member is sized to exhibit a different resonant frequency in the range of vibration frequencies of the rail compared to the first resonant member.

16. The clamp-on damper according to claim 1, in which the second resonant member has a different profile than the first resonant member.

17. The damper according to claim 1, in which the second resonant member is adapted and configured so as to engage the first deformable material of the first damper.

18. A rail having attached thereto the first damper and the clamp-on damper according to claim 1.

19. The rail according to claim 18, the clamp-on damper being positioned on the rail so as to cover a junction between a web and a foot of the rail.

20. The rail according to claim 18, in which at least one of said resonant members is an elongate angled section.

21. The rail according to claim 20, in which the section is angled so as to match an angle between external surfaces of the head and foot.

22. The clamp-on damper according to claim 1, wherein the resonant frequency of the first resonant member is different from the resonant frequency of the second resonant member.

23. The clamp-on damper according to claim 1, said first damper including a plurality of elongate resonant members separated by said deformable material of the first damper.

24. The clamp-on damper according to claim 23, wherein each resonant member of said first damper has a different resonant frequency.

* * * * *

UNITED STATES PATENT AND TRADEMARK OFFICE

CERTIFICATE OF CORRECTION

PATENT NO. : 7,641,129 B2
APPLICATION NO. : 10/547785
DATED : January 5, 2010
INVENTOR(S) : David Farrington It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 769 days.

Signed and Sealed this

Twenty-first Day of December, 2010

David J. Kappos

David J. Kappos
*Director of the United States Patent and Trademark Office*